United States Patent [19]

Caris

[11] 3,973,333

[45] Aug. 10, 1976

[54] SNOW SKI TRAINING DEVICE

[76] Inventor: Barry M. Caris, 1963 Berkeley Road, Highland Park, Ill. 60035

[22] Filed: Mar. 5, 1975

[21] Appl. No.: 555,677

[52] U.S. Cl. ..... 35/29 R; 272/97

[51] Int. Cl.[2] ..... A63B 23/00

[58] Field of Search ..... 35/29 R, 29 A, 29 B, 35/29 C, 29 D, 29 E, 29 F; 46/31; 116/1, 67 R; 272/57 B, 67, 80; 273/1 R

[56] References Cited

UNITED STATES PATENTS

| | | | |
|---|---|---|---|
| 3,419,276 | 12/1968 | Poggioli | 273/183 |
| 3,533,622 | 10/1970 | Foley | 273/1 R |
| 3,644,919 | 2/1972 | Mathauser | 340/279 |
| 3,677,551 | 7/1972 | Schaus | 273/183 B |
| 3,703,299 | 11/1972 | Kutchma | 280/11.37 E |
| 3,774,572 | 11/1973 | Borraccio | 116/67 R |

*Primary Examiner*—Harland S. Skogquist
*Attorney, Agent, or Firm*—Cushman, Darby & Cushman

[57] ABSTRACT

A snow ski training device comprising a pair of straps, one connected to each of a skier's legs just above the knee, and a releasable connection therebetween. The device provides a sensation, such as a popping noise, when the skier's knees are moved apart. The connection may take the form of a ball connected to or integral with one strap, and a cooperating socket connected to or integral with the other strap. The connection members may be made of silicone rubber to retain desired resilient properties even in very cold weather.

12 Claims, 11 Drawing Figures

SNOW SKI TRAINING DEVICE

BACKGROUND AND SUMMARY OF THE INVENTION

The invention relates in general to a device for teaching a beginner or intermediate skier good skiing habits, and in particular to a device for creating a sensation that a skier may sense when the skier moves his knees apart while "parallel" skiing. There have been prior art proposals for teaching a skier good skiing habits in general, such as shown in U.S. Pat. No. 3,644,919, and for teaching a skier to keep his knees together, such as shown in U.S. Pat. No. 3,774,572; however, such prior art devices have not been entirely successful in providing the necessary teaching function, and have been relatively speaking rather expensive to construct.

Proper parallel skiing is characterized by a skier having his body positioned directly over his skis, with both the knees and the ankles essentially together. According to the present invention, a ski training device is provided that provides a sensation when the skier's knees are moved apart, yet is not falsely triggered during the necessary back and forward and up and down movement of the skier's legs during skiing. The device according to the present invention is simple and easy to manufacture at relatively low cost, is readily adjustable to accommodate many different leg shapes, and provides a slight force for retaining the knees together to assist the skier in keeping them together, while still providing a connection that is readily releasable should a skier fall. According to a preferred embodiment of the present invention, the device includes a pair of straps, one for connection just above the knee of each leg, and means thereon for cooperation to provide a universal releasable connection.

The releasable connection according to the invention may take a variety of forms, but preferably takes the form of a ball and socket connection, which connection provides a "popping" sound that indicates to the skier that his knees have moved apart. While rough ball and socket releasable connections have been provided before in athletic training equipment — see U.S. Pat. Nos. 3,419,276 and 3,677,551, for example — none are known for providing a universal joint connection between two relatively movable members, nor affixed to straps for placement around a skier's legs to indicate to the skier that his knees have moved apart. The straps and connection members may be moulded of one piece of silicone rubber, which makes them inexpensive to manufacture and provides the necessary resiliency even under extremely cold weather conditions.

It is the primary object of the present invention to provide an improved device for indicating to a skier that his knees have moved apart during skiing. This and other objects of the invention will become clear from an inspection of the detailed description of the drawings, and from the appended claims.

DETAILED DESCRIPTION OF THE INVENTION

Figure 2B:
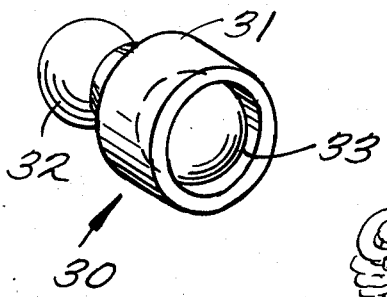
FIG. 2*b* is a perspective view of an adjustment bead member that may be utilized with the embodiment of the invention shown in FIG. 2*a* to accommodate different leg shapes, and FIGS. 3–10 disclose other embodiments of connection means according to the present invention.
Figure 1:
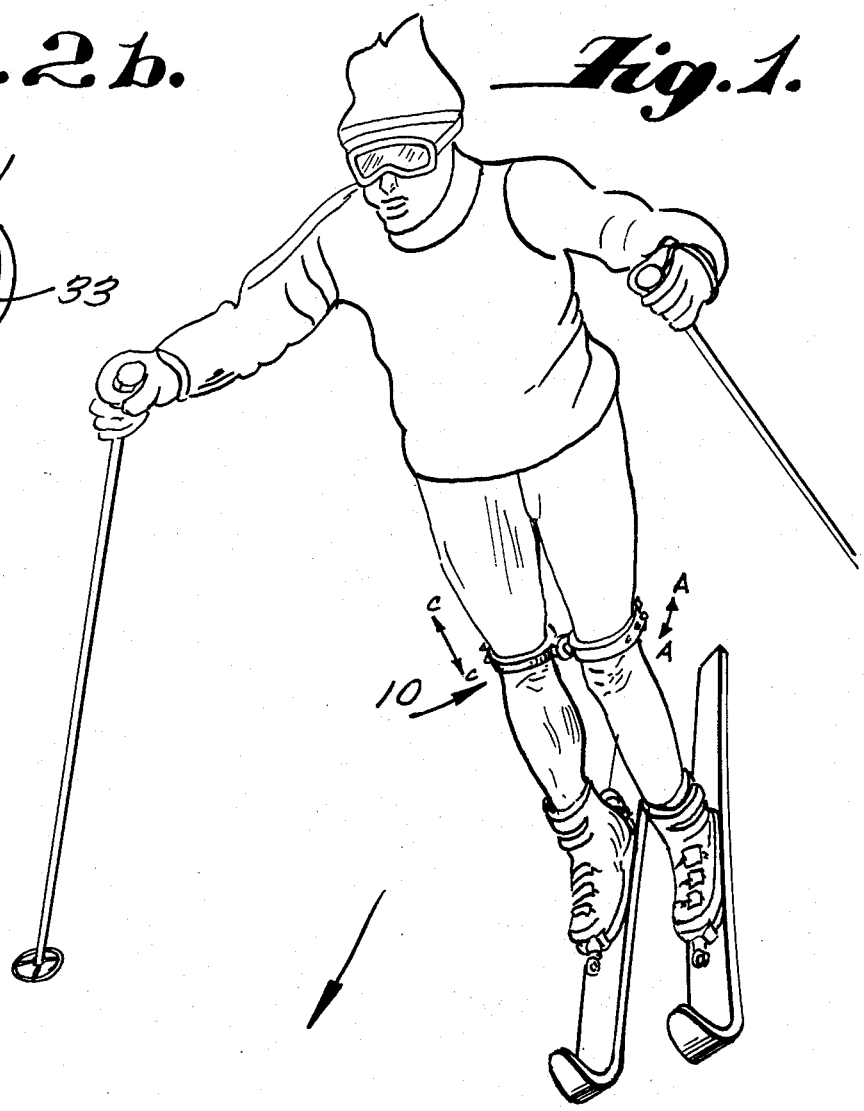
FIG. 1 is a perspective view of a skier using an exemplary device according to the present invention, while maintaining proper knee position.
Figure 2A:
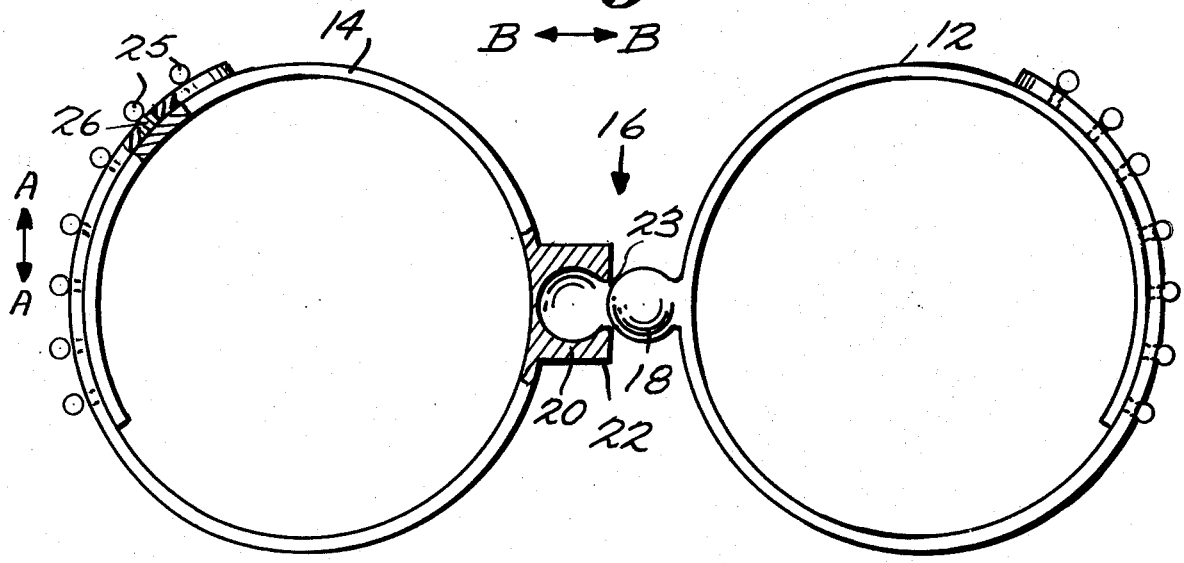
FIG. 2*a* is a top view of an exemplary device according to the present invention, partly in plan and partly in section.

An exemplary device according to the present invention is shown generally at 10 in FIGS. 1 and 2*a*. The device includes a first strap means 12 for attachment just above one knee of a skier, a second strap means 14 for attachment just above the other knee of a skier, and a releasable universal connection 16 therebetween. The strap means 12 and 14 may be formed of any suitable material, and are preferably adjustable so as to accommodate legs of different sizes. One adjustment means that could be provided is a plurality of ball fasteners 25 formed on one end of a strap and a plurality of holes 26 formed in the other end of the strap, the ball fasteners and holes cooperating to provide an adjustable connection between the strap ends. Many other suitable adjustable fastener means could also be provided, for instance, cooperating Velcro strip sections formed on each end of each of the straps, a buckle, snaps, etc.

The releasable connection 16 between the strap means 12, 14 may take a variety of forms, as long as a releasable, universal connection is formed thereby. A preferred embodiment of the connection according to the invention is shown in FIG. 2*a*. This connection takes the form of a ball connection member 18 for cooperation with a socket connection member 20, each of the members affixed to a respective strap 12, 14 and one or both of the members 18, 20 formed of relatively resilient material. The shoulder portion 22 of the socket 20 may be formed to different sizes in order to provide for differing amounts of force for maintaining the ball and socket connection members together. Also, the portion 23 of socket 20 is preferably chamfered in order to provide for ease of connection of members 18 and 20, and for providing relative movement between the ball and socket connection members generally in the direction of arrows A—A and C—C.

A ball and socket connection 18, 20 is especially advantageous since it does allow for a great amount of relative movement between one's legs, except in a direction directly apart from each other. During skiing, it is essential that a skier be able to move his legs back and forth and up and down with respect to each other (along the direction of arrows A—A and C—C in FIG. 1) in order to properly execute turns, etc. To be effective, a ski training device must not falsely trigger when such normal relative knee movement takes place. A ball and socket connection 18, 20, such as shown in FIG. 2*a*, is ideally suited for this situation since it allows a great deal of relative movement between the legs in any direction except directly apart (direction of arrows B—B in FIG. 2*a*). As the skier's legs move back and forth and up and down with respect to each other, the straps 12 and 14 will rotate about the legs of the skier as the connection between connecting members 18 and 20 is maintained. Should a force having a component along the direction of arrows B—B in FIG. 2*a* that is too great be exerted, however, the connection members will separate.

The connection members 18, 20 provide a sensation when moved apart. Preferably, this sensation takes the form of an audible sound — a popping noise — and such a sound is inherent in the provision of a ball and socket connection of resilient materials. Of course, a visual indication is also provided thereby, and other sensations may be applied thereby if accessory structures are used.

Since skiing is done in relatively cold weather, it is important to provide connection members that do not lose their desirable properties when exposed to cold ambient temperatures over a long period of time. Since one or both of the ball and socket members 18, 20 must be relatively resilient, it is necessary to make them out of a material that will not lose its resilient properties in cold weather. Such a material has been found to be silicone rubber, although there are other suitable materials. When silicone rubber or a like plastic material is used, it is also possible to mold each of the straps 12, 14 and its associated connection member 18, 20 in one-piece out of the material. This of course cuts down on the costs of manufacture.

Also, the connection 16 is readily adjustable, both as to length of the connecting members as well as to the holding force provided thereby. To provide for length adjustment, one means that may be employed is a bead member 30 such as shown in FIG. 2*b*. The bead member 30 has a body member 31 with a ball 32 formed at one end thereof, corresponding in size and shape to ball 18, and a socket 33 at the other end thereof, corresponding in size and shape to socket 20. By connecting one or more of such bead members 30 between the ball and socket members 18, 20, a connection 16 of adjustable length may be provided.

Figure 3:
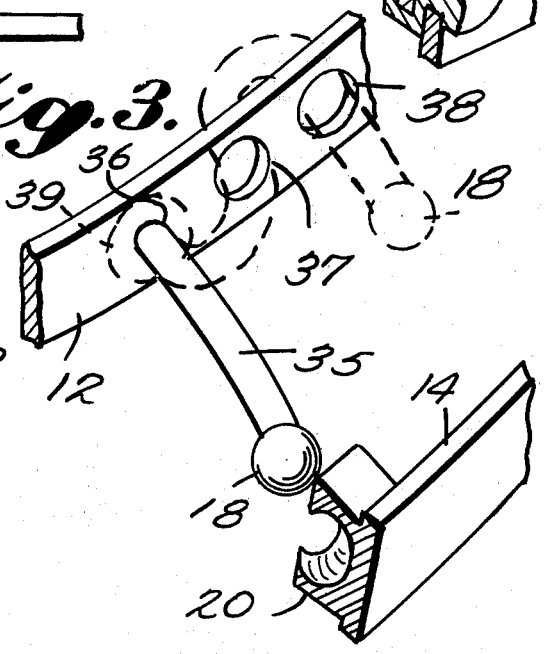

Another means for providing for adjustable length between the strap members during connection is shown in FIG. 3. This embodiment of the invention contemplates the connection of the ball 18 to a flexible "thong" 35, which thong is affixed to a strap 12, either being molded therewith, or passing through an opening 36 therein and having an abutment member 39 at the other end thereof. As shown in solid line in FIG. 3, the ball 18 may be connected directly to the socket while the thong 35 is extended, or as shown in dotted line in FIG. 3, the thong 35 may be passed or "woven" through holes 37 and 38 in strap 12 in order to shorten the distance of the ball from the strap 12. Each of the holes 37, 38 is preferably dimensioned to allow a relatively free though tight passage of the ball 18 therethrough, and any number of holes 37, 38 may be provided.

Figure 4:
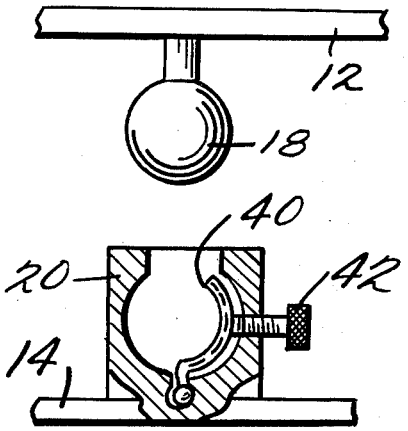

Another form of adjusting the retaining forces between the ball and socket members is shown in FIG. 4. This embodiment of the invention contemplates the provision of a spring member 40 having a pivotal or cantilever mount within socket 20, and an adjustment screw 42 for cooperation therewith. By adjustment of the screw 42, the pressure the socket 20 exerts on the ball 18 may be adjusted. In such a situation the ball and socket members need not be of resilient material, the resiliency of the connection being provided by spring 40.

Other modifications of a ball and socket connection could also be provided. For instance, the socket could take the form of an opening formed in strap 14, or a cylinder connected thereto.

The method of using the device 10 according to the present invention is generally as follows: Before traversing a slope, a skier attaches one strap 12 just above the knee of one leg, and the other strap 14 just above the knee of the other leg, with the connection members 18, 20 thereof disposed toward each other. The straps

12 and 14 are preferably put on quite tightly, tightly enough so that there will be no chance of them moving downwardly over the knees. Then the knees are brought together, care being taken that the members 18 and 20 engage. Then the skier "parallel" skis down the slope normally, concentrating on keeping his knees together. The members 18, 20 provide a small force for keeping the knees together, but the force is not large enough to prevent release thereof in emergency situations. Should the skier inadvertently move his knees apart during skiing, the members 18 and 20 will separate with a popping sound, thereby giving the skier a clear indication that his knees have separated. Then the skier need merely move his knees together again, taking care to see that the engagement between members 18 and 20 is again made, and continue on. Of course, skiing with the members separated is possible, no hindrance being provided thereby.

Figure 5:
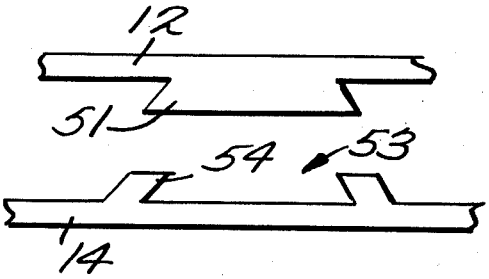

While the invention has been shown above in a preferred embodiment, it should be understood that other connection means 16 may be employed for providing a releasable connection between straps 12 and 14. Exemplary alternative embodiments for the connection 16 are shown in FIGS. 5—10. FIG. 5 shows a tapered flange 51 and socket 53 arrangement, the socket 53 having a lip 54 formed therewith for retention of the tapered flange member 51. Both the flange and socket could be circular in plan.

Figure 6:
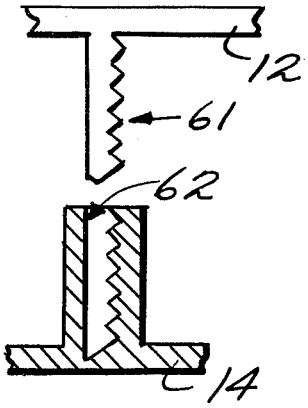

FIG. 6 shows a pair of ratchet members 61, 62 for cooperation to provide a releasable connection. Male member 61 has a plurality of teeth formed thereon for cooperation with the teeth formed on one interior wall of socket member 62, whereby an adjustable length releasable connection is provided.

Figure 7:
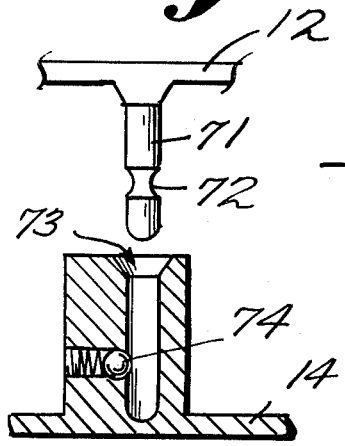
Figure 10:
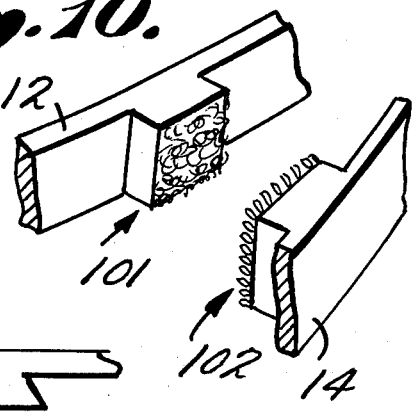

FIG. 7 shows a releasable connection consisting of a shaft with detent male member for cooperation with a ball and cylinder female member. A shaft 71 may have one or more detent indentations 72 formed therein. Upon insertion of the shaft 71 into cylinder 73, the detent cooperates with spring-pressed ball 74. Alternatively, the spring-socket retaining member could take the form of a spring clip instead of spring-pressed ball 74, or a plurality of resilient projections could be formed along the length of the interior of the cylinder 73 for cooperation with one or more detents 72 on shaft 71, whereby an adjustable connection may be provided.

Figure 8:
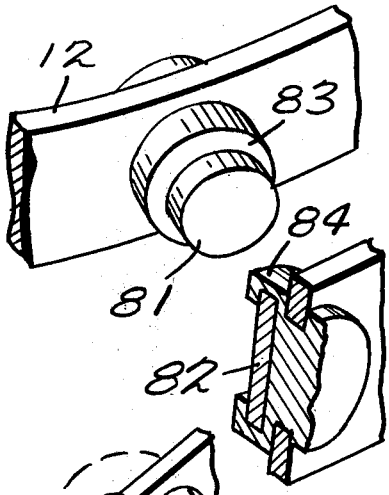
Figure 9:
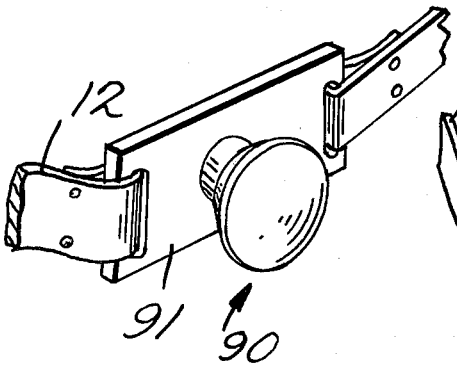
Figure 9:
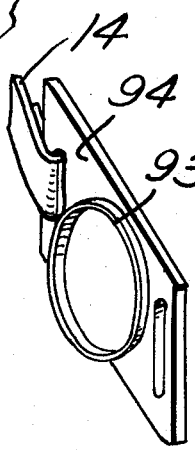

FIGS. 8–9 show other embodiments of connection means 16 that may be employed. The FIG. 8 embodiment contemplates cooperating attracting permanent magnets 81, 82 being retained within sockets 83 and 84 of respective strap members 12, 14. The FIG. 9 embodiment contemplates a suction cup 90 affixed to a plate 91 attached to strap means 12 for cooperation with a raised ridge 93 formed on a plate 94 attached to strap 14. The FIG. 10 embodiment contemplates a pair of cooperating Velcro strip members, 101, 102, each for attachment to a strap 12, 14. The strip members make a "ripping" sound when separated. The lengths of the strips may be elongated from that shown in FIG. 10, and one strip may actually extend from the strap to which it is connected, having a free end thereof, and be "wrapped" around a cooperating portion formed on the other strap.

While the invention has been herein shown and described in what are presently conceived to be the most practical and preferred embodiments of the invention, it will be apparent to one of ordinary skill in the art that many other modifications could be made thereof within the scope of the invention, which scope is to be accorded the broadest interpretation of the appended claims so as to encompass all equivalent structures and devices.

What is claimed is:

1. A snow ski training device comprising means to indicate to a skier that his knees have moved apart but not providing a false indication upon normal backward and forward and up and down movement of the legs, said means comprising a first strap means for connection above the knee on one of the skier's legs, a second strap means for connection above the knee of the other of the skier's legs, and means for providing a releasable secure connection between said first strap means and said second strap means when the skier's legs are held together during normal skiing, said secure connection being maintained during normal backward and forward and up and down movement of the legs during normal skiing, and said means for providing a sensation only when the knees are moved apart and the connection is broken.

2. A device as recited in claim 1 wherein said means for providing a releasable connection include a ball and socket connection, the ball of said connection being operatively connected to one strap means, and the socket of said connection being operatively connected to the other of said strap means, whereby a releasable universal joint connection is provided thereby.

3. A device as recited in claim 2 further comprising an extension for said connection, said extension comprising a bead having a ball formed at one end thereof for cooperation with said socket of said connection, and a socket at the other end thereof for cooperation with said ball of said connection.

4. A device as recited in claim 3 further comprising a plurality of said beads, said beads being connectable to each other and to said ball and socket of said connection to provide an adjustable extension of said connection.

5. A device as recited in claim 2 wherein said ball and socket connection components are formed out of resilient material that have resilient properties that are not affected by cold ambient temperatures.

6. A device as recited in claim 5 wherein said material is silicone rubber.

7. A device as recited in claim 2 wherein said ball and said strap means connected thereto are molded of a single piece of silicone rubber, and wherein said socket and said strap means connected thereto are molded of a single piece of silicone rubber.

8. A device as recited in claim 2 wherein said ball is connected to the end of a flexible tongue member extending from the strap means to which said ball is connected may be adjusted.

9. A device as recited in claim 2 wherein said socket includes means for readily adjusting the fit between the ball and the socket and therefore the pressure holding said ball and socket connection members together.

10. A device as recited in claim 1 wherein said releasable connection providing means comprises a pair of Velcro strips, one affixed to each of said strap means.

11. A device as recited in claim 1 wherein said releasable connection providing means comprises a flange connected to one strap means, and a socket with lip affixed to the other of said strap means.

12. A device as recited in claim 1 wherein said releasable connection providing means comprises cooperating ratchet members, one affixed to each of said strap means.

* * * * *